US007857480B2

(12) United States Patent
Steele et al.

(10) Patent No.: US 7,857,480 B2
(45) **Date of Patent: *Dec. 28, 2010**

(54) FLASHLIGHT SYSTEM AND METHOD OF USING SAME

(75) Inventors: Gavin A. Steele, White Heath, IL (US); Jeremy B. Ross, Monticello, IL (US)

(73) Assignee: First-Light USA, LLC, Seymour, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/415,557

(22) Filed: Mar. 31, 2009

(65) Prior Publication Data

US 2009/0190337 A1 Jul. 30, 2009

Related U.S. Application Data

(63) Continuation of application No. 11/859,580, filed on Sep. 21, 2007, now Pat. No. 7,510,294.

(60) Provisional application No. 60/846,367, filed on Sep. 21, 2006.

(51) Int. Cl.
*F21L 4/00* (2006.01)

(52) U.S. Cl. ..... 362/197; 362/208

(58) Field of Classification Search ..... 362/109, 362/110, 190, 191, 194, 200, 202, 204, 205, 362/208; 396/176

See application file for complete search history.

(56) References Cited

U.S. PATENT DOCUMENTS

| | | | | |
|---|---|---|---|---|
| 1,119,663 | A | 12/1914 | Swallow | |
| 1,599,499 | A | 9/1926 | St John | |
| 1,763,815 | A | 6/1930 | Pajeau | |
| 2,132,063 | A | 10/1938 | Whaley | |
| 2,356,396 | A | 8/1944 | Gonseor | |
| 2,366,202 | A | 1/1945 | Lippincott | |
| 3,441,730 | A * | 4/1969 | Brindley et al. | 362/183 |
| 3,601,595 | A | 8/1971 | Kivela | |
| 3,970,228 | A | 7/1976 | Keller | |
| 4,422,130 | A * | 12/1983 | Nomura | 362/183 |

(Continued)

OTHER PUBLICATIONS

Dive Lights International, Inc., NiteRider® Dive Lights, http://www.niteriderdive.com printed Dec. 12, 2005, 5 pages, date of first publication unknown.

(Continued)

*Primary Examiner*—Hargobind S Sawhney
(74) *Attorney, Agent, or Firm*—Douglas W. Rommelmann; Andrews Kurth LLP

(57) ABSTRACT

A multi-function flashlight device in one preferred embodiment comprising a housing assembly having a tubular member for gripping the device in a user's hand, a control housing coupled to the tubular member, and a lamp housing coupled to the control housing and having a light source mounted therein. The light source has an optical axis that is substantially perpendicular to a longitudinal axis of the tubular member. Batteries are housed in the tubular member. A control panel having a keypad overlay is mounted in the control housing. The keypad overlay includes a plurality of control buttons. A driver board in the control housing receives signals from the control panel and control the operation of the light source. The plurality of control buttons are manipulable by a single digit of the user's hand while gripping the tubular member.

8 Claims, 14 Drawing Sheets

U.S. PATENT DOCUMENTS

| | | | | |
|---|---|---|---|---|
| 4,533,982 | A | 8/1985 | Kozar | |
| 4,782,432 | A | 11/1988 | Coffman | |
| 5,167,446 | A | 12/1992 | Haroutunian | |
| 5,178,477 | A | 1/1993 | Gambaro | |
| 5,239,451 | A | 8/1993 | Menke et al. | |
| 5,278,739 | A | 1/1994 | Gammache | |
| 5,305,033 | A * | 4/1994 | Takahashi et al. | 396/429 |
| 5,332,322 | A | 7/1994 | Gambaro | |
| 5,410,457 | A | 4/1995 | Parker | |
| 5,429,119 | A | 7/1995 | Griffin et al. | |
| 5,558,430 | A | 9/1996 | Booty, Jr. | |
| 5,593,074 | A | 1/1997 | Matthews | |
| 5,629,679 | A | 5/1997 | Cranford et al. | |
| 5,632,548 | A | 5/1997 | Mayfarth | |
| 5,642,932 | A | 7/1997 | Matthews | |
| 5,667,293 | A | 9/1997 | Own | |
| 5,790,013 | A | 8/1998 | Hauck | |
| 5,848,834 | A | 12/1998 | Kerr | |
| 5,859,582 | A | 1/1999 | Yuen | |
| 5,921,657 | A | 7/1999 | Case | |
| 6,145,169 | A | 11/2000 | Terzuola | |
| 6,190,025 | B1 | 2/2001 | Solinsky | |
| 6,270,231 | B1 | 8/2001 | Kerr | |
| 6,272,004 | B1 | 8/2001 | McDermott | |
| 6,388,390 | B2 | 5/2002 | Rachwal | |
| 6,612,714 | B1 | 9/2003 | Morre et al. | |
| 6,641,277 | B2 | 11/2003 | Smith | |
| 6,722,771 | B1 | 4/2004 | Stephens | |
| 6,788,011 | B2 | 9/2004 | Mueller et al. | |
| 6,808,287 | B2 | 10/2004 | Lebens et al. | |
| 6,817,730 | B2 | 11/2004 | Sharrah et al. | |
| 6,877,878 | B2 * | 4/2005 | Raskas | 362/253 |
| 6,916,104 | B2 | 7/2005 | Parsons et al. | |
| 7,064,498 | B2 | 6/2006 | Dowling et al. | |
| 7,172,311 | B2 | 2/2007 | Ross | |
| 7,220,016 | B2 | 5/2007 | Matthews et al. | |
| 7,303,306 | B2 * | 12/2007 | Ross et al. | 362/191 |
| 2002/0021573 | A1 * | 2/2002 | Zhang | 362/555 |
| 2004/0032750 | A1 | 2/2004 | Watts et al. | |
| 2004/0228120 | A1 | 11/2004 | Ross | |
| 2005/0122710 | A1 | 6/2005 | Kim | |
| 2005/0122712 | A1 | 6/2005 | Kim | |
| 2005/0237737 | A1 | 10/2005 | Kim | |
| 2006/0050502 | A1 | 3/2006 | Ross et al. | |

OTHER PUBLICATIONS

Technology Associates, Inc., eternaLight Model 3 Ergo RW Option, http://www.techass.com/el/rwgwelm30rw.php, printed Oct. 12, 2007, 3 pages, date of first publication unknown.

Technology Associates, Inc., eternaLight Rave'n2 party light Operations and Maintenance Manual-Version 2.0, © 2001, http://www.techass.com/el/docs/rav2man.pdf, 4 pages.

Technology Associates, Inc. eternaLight EliteMAX Model No. 4Z Operations and Maintenance Manual—Version 1.0, © 2003, 4 pages.

Company Seven, Consumer Lines, Rigel Systems Flashlights, © 1998-2003, http://www.techass.com/el/docs/rav2man.pdf, 4 pages.

International Search Report—Counterpart Int'l Application No. PCT/US 07/079232, Apr. 17, 2008, 7 pages.

* cited by examiner

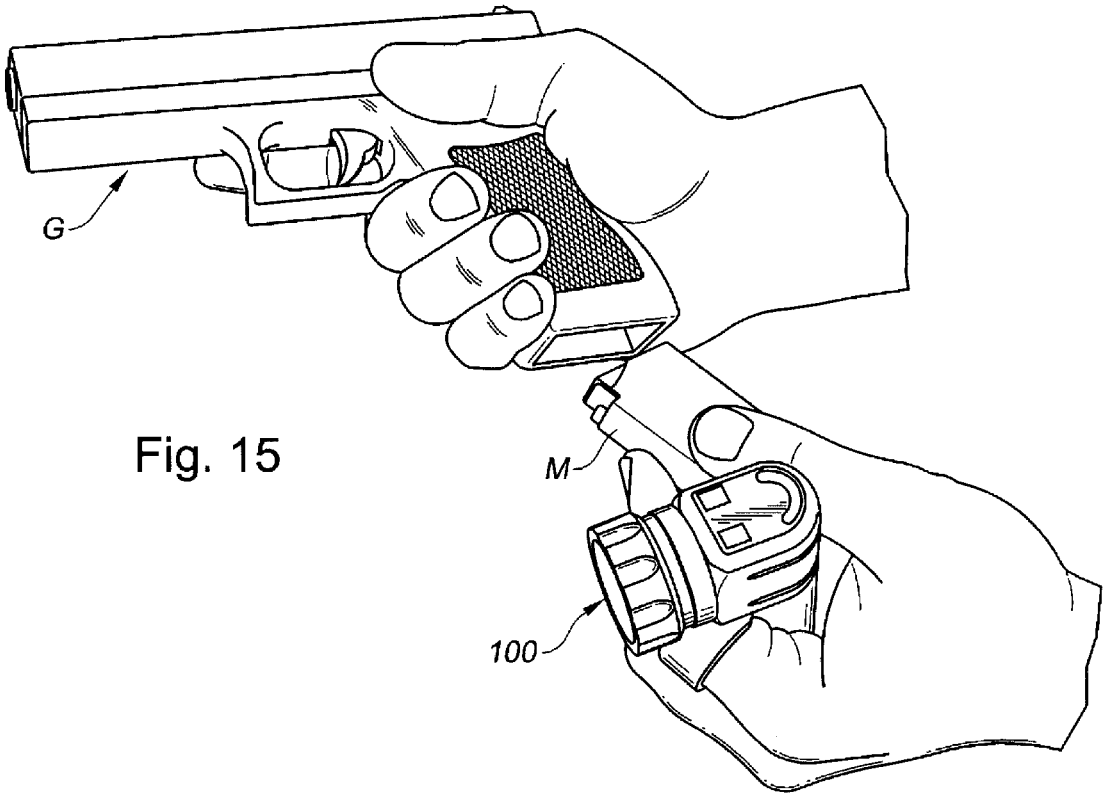
Fig. 15
Fig. 16
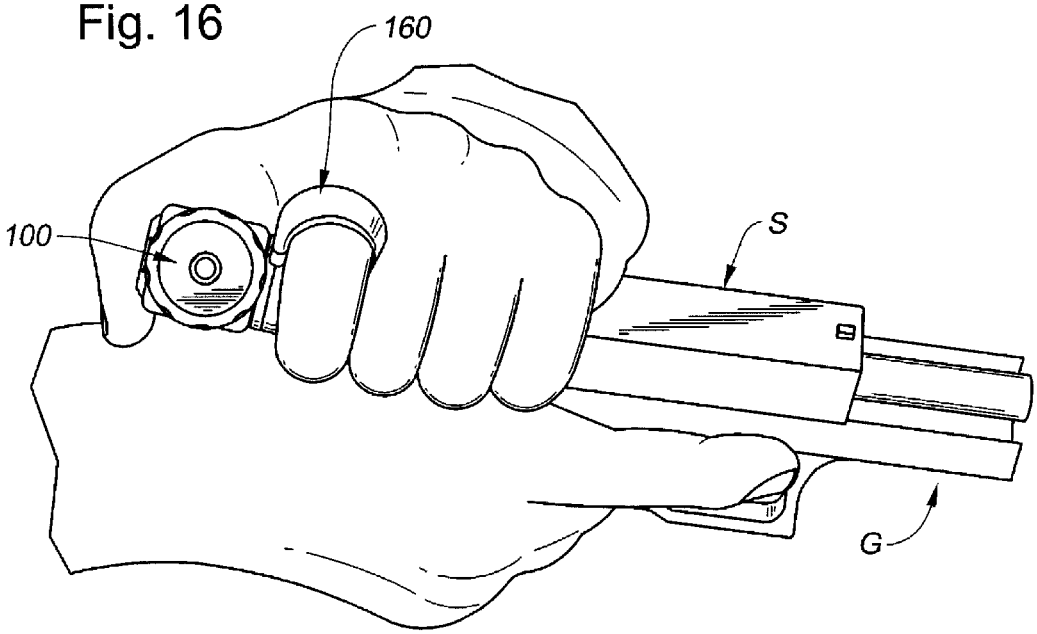

FLASHLIGHT SYSTEM AND METHOD OF USING SAME

CROSS-REFERENCE TO RELATED APPLICATIONS

This application is a continuation application of U.S. application Ser. No. 11/859,580, filed Sep. 21, 2007, issued as U.S. Pat. No. 7,510,294 on Mar. 31, 2009, which claims priority to U.S. Provisional Application No. 60/846,367, filed Sep. 21, 2006. Applicant incorporates by reference herein Applicant's U.S. Provisional Application No. 60/846,367 in its entirety.

BACKGROUND OF THE INVENTION

1. Field of the Invention

The present invention relates generally to flashlights and methods of using same, and in particular to a flashlight system adapted for convenient use in conjunction with other hand-held implements, such as firearms, or in conjunction with activities requiring the use of one's hands.

2. Description of the Related Art

A number of flashlights or flashlight holders are known that are designed for use in conjunction with other hand-held implements, such as, for example, firearms. See U.S. Pat. Nos. 6,270,231; 5,848,834; 5,167,446; 4,542,447; 5,642,932; 5,363,285; 5,556,003; 5,345,368; 6,023,875; 5,752,633; 5,533,657; and 5,593,074; and European Pat. No. EP0484891.

In spite of prior work in the area, there remain needs for improved flashlight devices for potential use in conjunction with other hand-held implements such as firearms, particularly in self-defense and/or combat situations, or when performing other tasks or activities that require two handed operation such as those that commonly occur in industrial environments or outdoor activities. The present invention is directed to these needs. Applicants have met some of these needs with the devices and methods disclosed in U.S. application Ser. No. 11/261,027 and U.S. Pat. No. 7,172,311, both of which Applicants incorporate by reference herein in their entireties.

SUMMARY OF THE INVENTION

A multi-function flashlight device in one preferred embodiment comprises a housing assembly having a tubular member for gripping the flashlight device in a user's hand, a control housing coupled to the tubular member, and a lamp housing coupled to the control housing and having a light source mounted therein. The light source has an optical axis that is substantially perpendicular to a longitudinal axis of the tubular member. Batteries are housed in the tubular member. A control panel having a keypad overlay is mounted in the control housing. The keypad overlay includes a plurality of control buttons. A driver board in the control housing receives signals from the control panel and control the operation of the light source. The plurality of control buttons are manipulable by a single digit of the user's hand while gripping the tubular member.

Another feature of a preferred embodiment of the present invention is a finger retainer assembly coupled to the tubular member. The finger retainer assembly is preferably arranged and designed to be adjustable relative to said optical axis, preferably adjustable through 360°.

Another feature of a preferred embodiment of the present invention is a retention system having a first component coupled to the tubular member and a second component arranged and designed to be attached to the user's clothing, with the second component including a receptacle for releasably receiving the first component.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which:

FIG. 15 is a perspective view illustrating the removal or insertion of a firearm's magazine with the flashlight device attached to the user's hand; and FIG. 16 is a perspective view illustrating the operation of a firearm's slide with the flashlight device attached to the user's hand.

DESCRIPTION OF THE PREFERRED EMBODIMENTS

Figure 10:
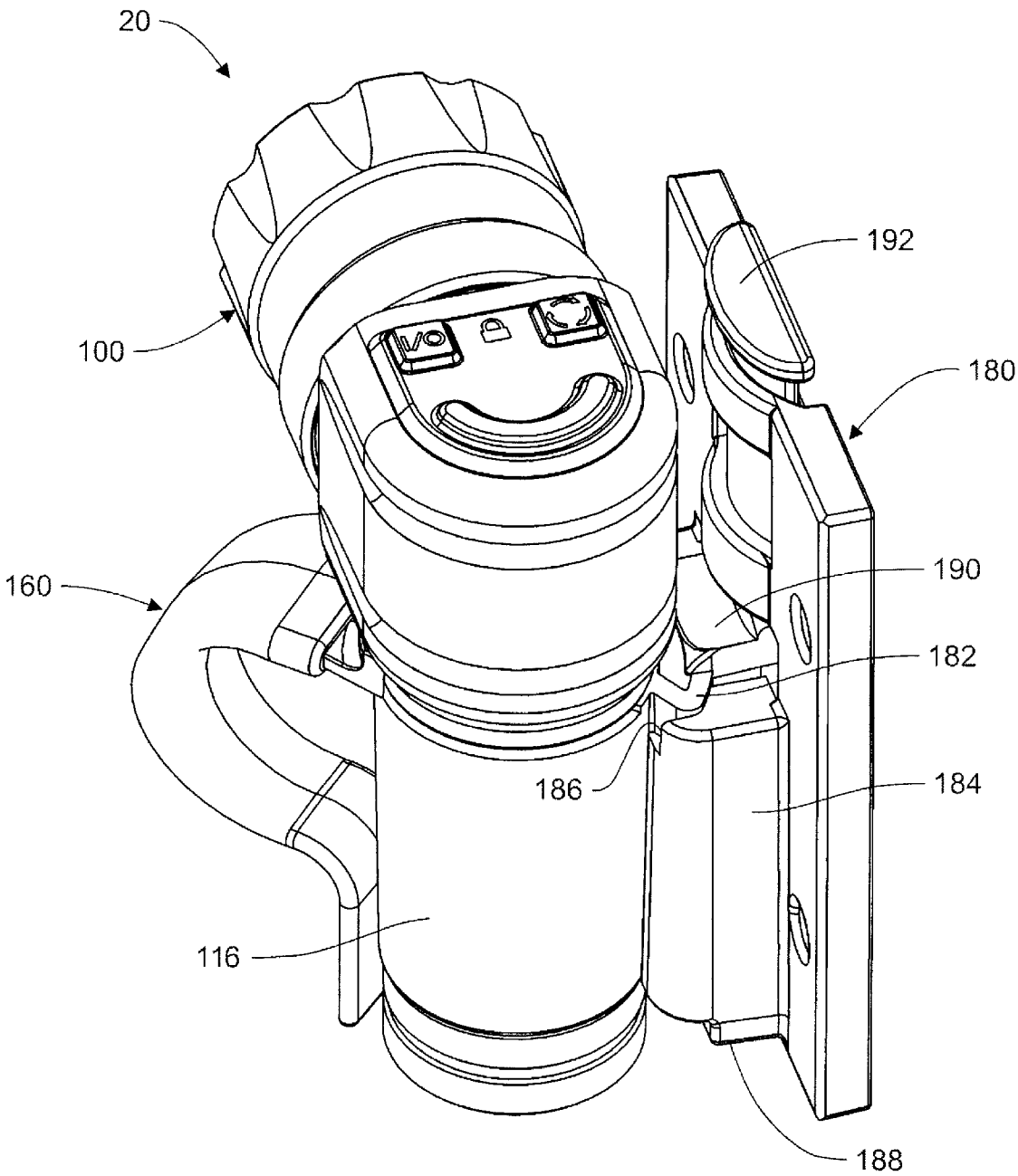
FIG. 10 is a perspective view showing the flashlight device with the engaged tactical retention system.

The flashlight system according to a preferred embodiment of the present invention will now be described with specific reference to the drawings. The flashlight system, generally referred to as 20, comprises a flashlight device 100, a finger retainer assembly 160 and a retention system 180 as shown in FIG. 10.

Figure 1:
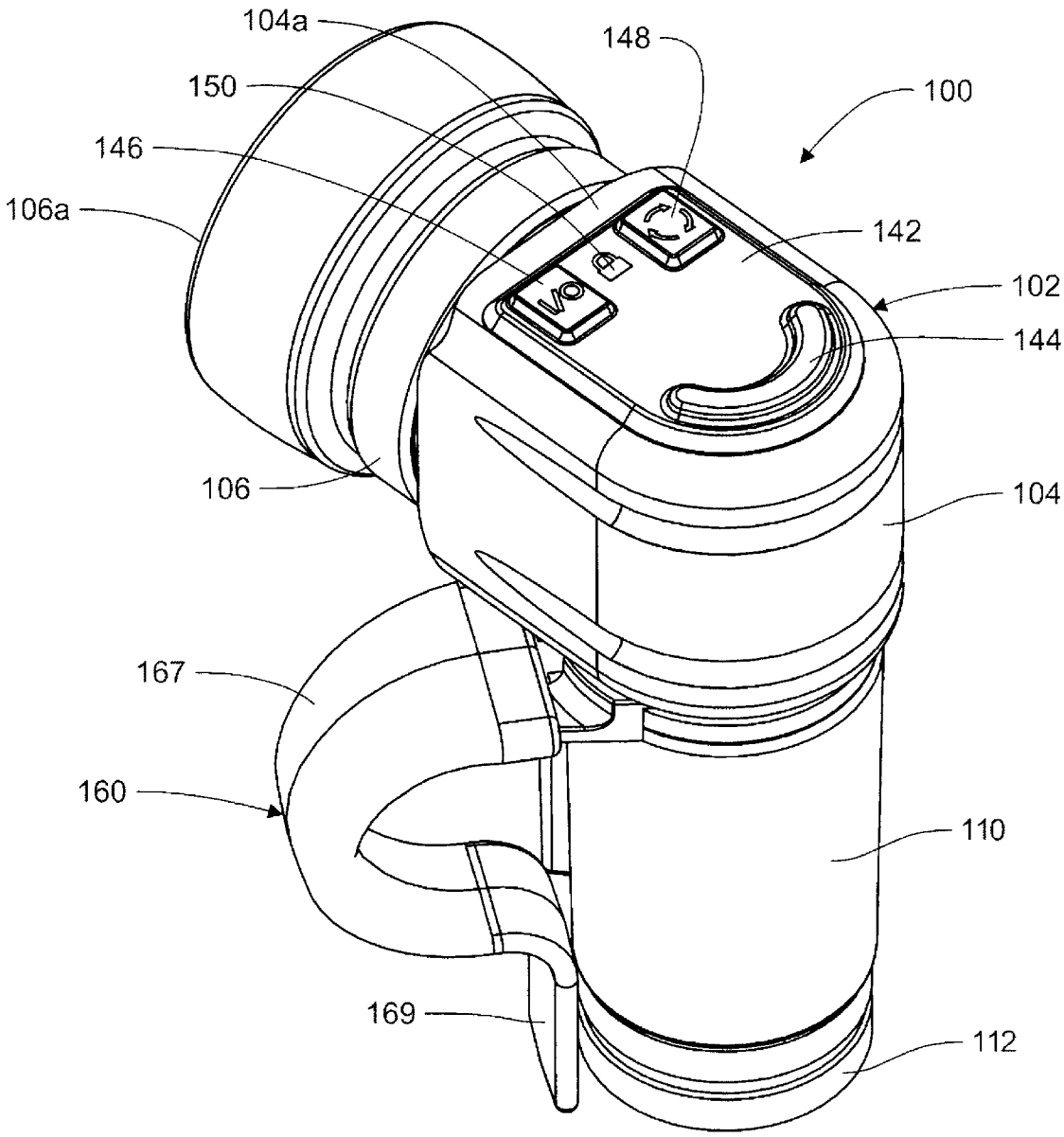
FIG. 1 is a perspective view of a flashlight device according to a preferred embodiment of the present invention.
Figure 3:
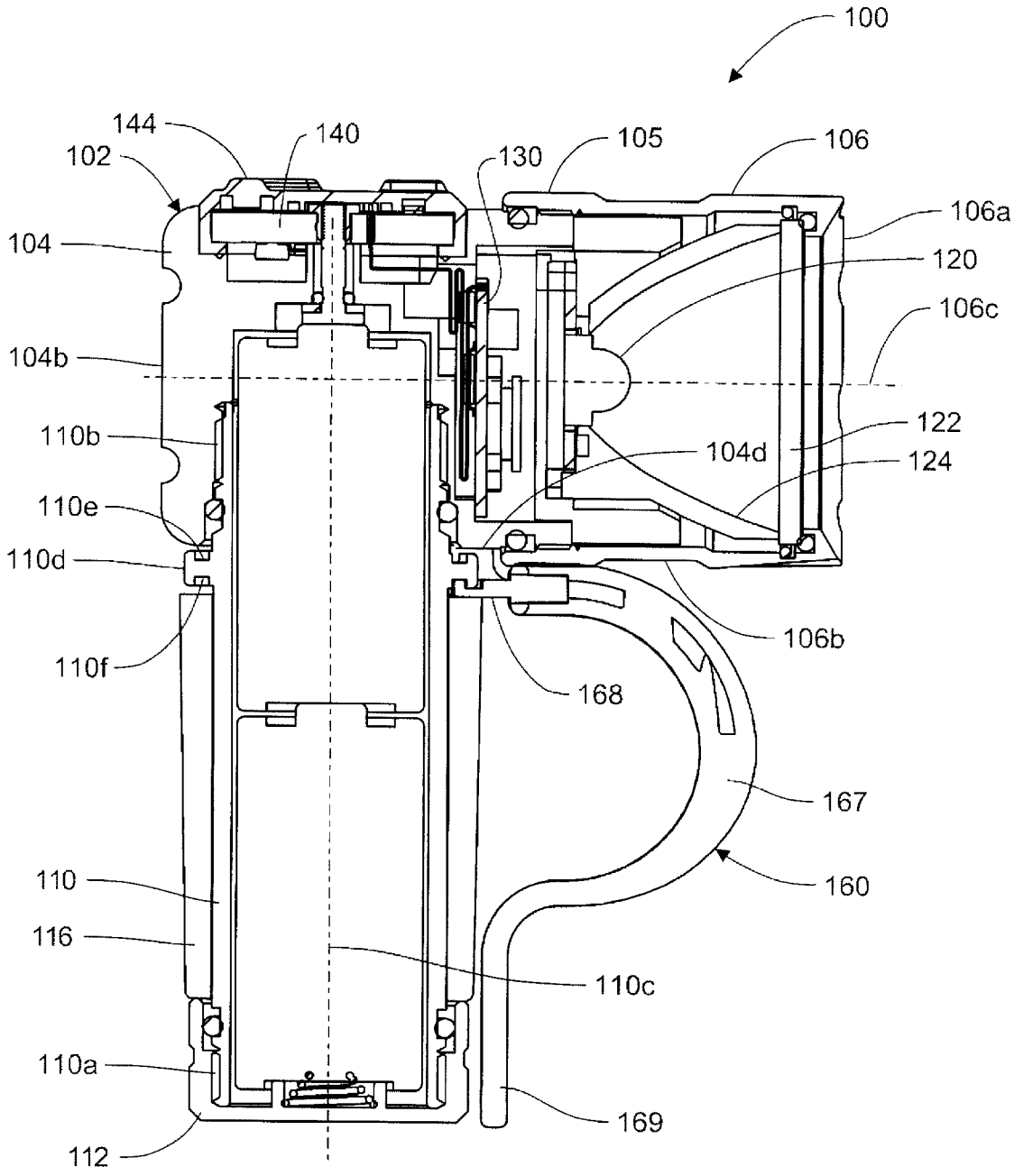
FIG. 3 is a side elevation section view of the flashlight device of FIG. 1.

A preferred embodiment of the flashlight device 100 is shown in perspective view in FIG. 1. The flashlight device 100 includes a housing assembly 102, preferably manufactured from a sturdy and durable material, for example, aluminum. Preferably, the housing assembly 102 includes a control housing 104, a lamp housing 106 and a tubular member 110. The tubular member 110, preferably substantially hollow and cylindrical, has a threaded tail cap 112 removably attached to a lower end 110*a* of the tubular member 110 as shown in FIG. 3. The tubular member 110 is adapted to house one or more batteries 114 for powering the flashlight device 100. In the preferred embodiment, the tail cap 112 is removable from the tubular housing 110 to replace and/or insert batteries 114 in the flashlight device 100. An upper end 110*b* of the tubular member 110 is coupled, preferably threadedly attached, to the control housing 104. Still referring to FIG. 3, the control housing 104 is coupled to the lamp housing 106, preferably via a threaded connection 105.

In the preferred embodiment of the present invention, the tubular member 110 has a centerline or longitudinal axis 110*c* and the control housing 104 and the lamp housing 106 have a common centerline or longitudinal axis 106*c*. Preferably, the control housing 104 is coupled to the tubular member 110 such that the respective centerlines 106*c*, 110*c* intersect and form substantially a 90 degree (90°) angle.

Figure 2:
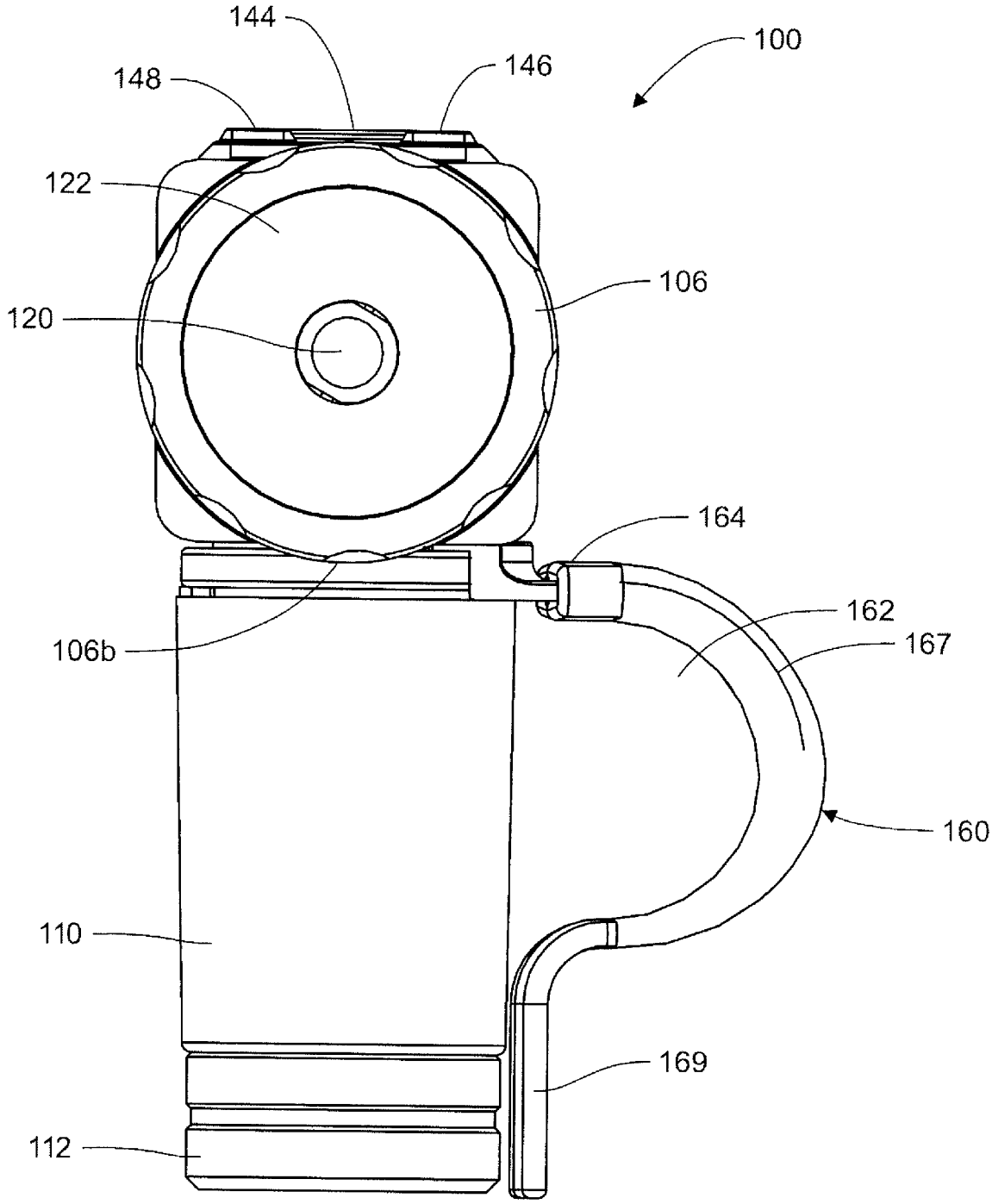
FIG. 2 is a front elevation view of the flashlight device of FIG. 1.

Referring to FIGS. 2 and 3, the lamp housing 106 includes at least one light source 120 and a reflector 124 positioned behind a lens 122 at a forward end 106*a* of the lamp housing 106. The light source 120 is energizable by the batteries 114, preferably lithium batteries, in the housing assembly 102. Preferably, the light source 120 is capable of delivering a high intensity white light at least about 20,000 candle power (CP), typically in the range of about 20,000 to about 50,000 CP. Higher or lower intensities may also be desirable for particular utilities for the flashlight device 100. The light source 120 may, for example, include a halogen, xenon or other pressurized gas bulb, or a light emitting diode (LED).

Figure 4:
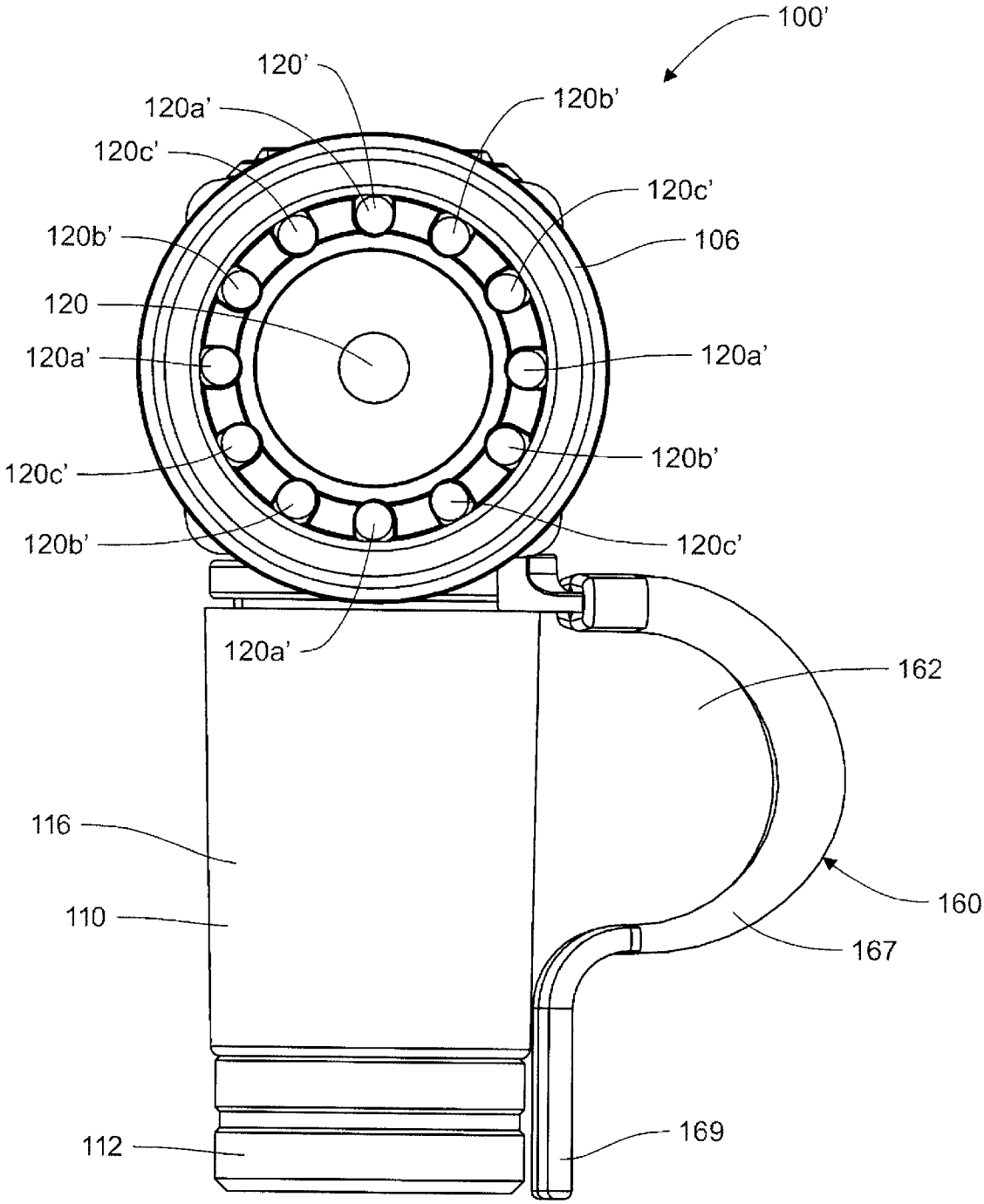
FIG. 4 is a front elevation view of a second preferred embodiment of the flashlight device of FIG. 1.
Figure 5:
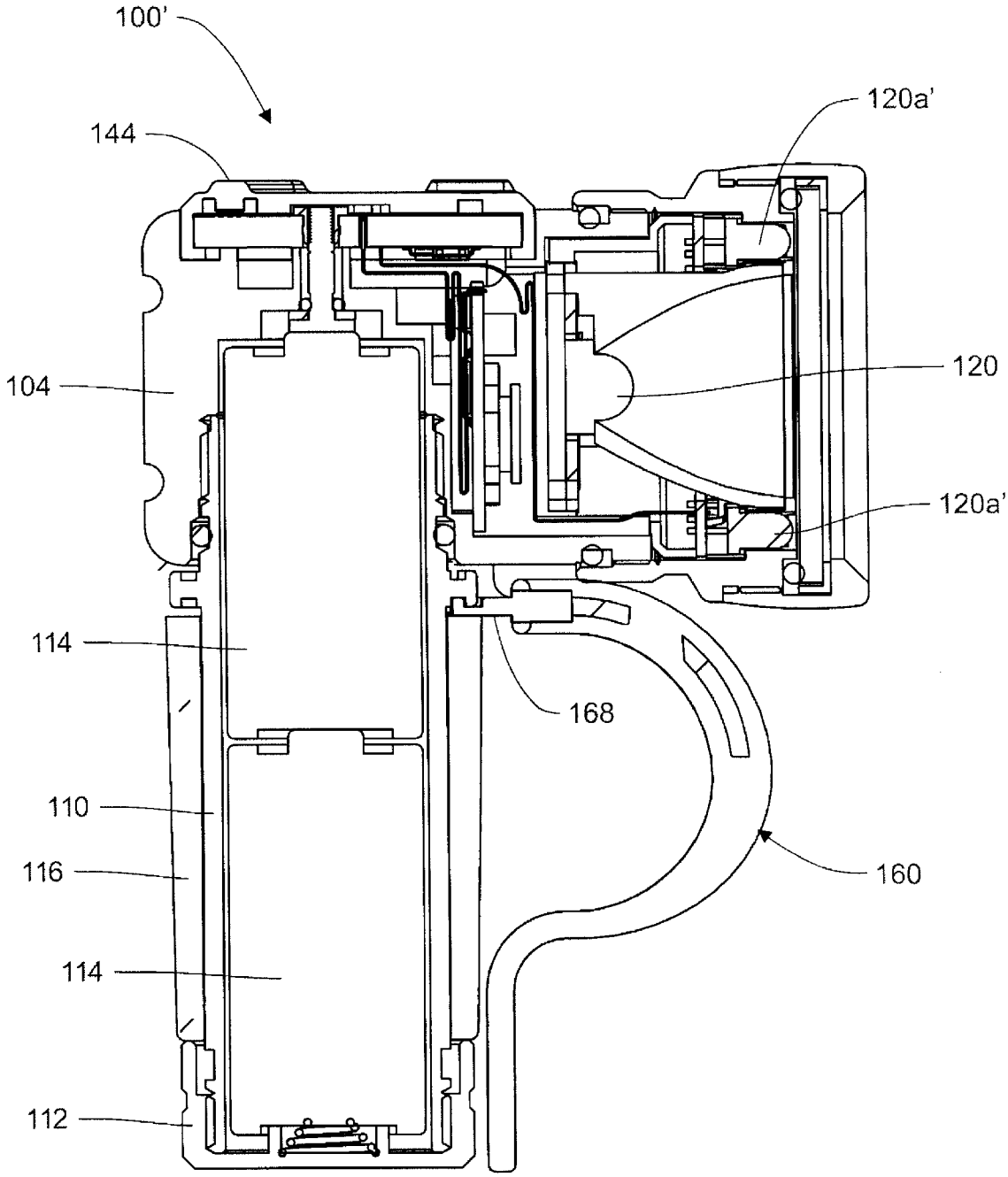
FIG. 5 is a side elevation section view of the second embodiment of the flashlight device.

Additionally, it is to be understood that while the flashlight device 100 of FIGS. 2 and 3 includes a single light source 120, the present invention may alternatively have a plurality of light sources, including light sources of different output wavelengths or color and/or intensities. For example, FIGS. 4 and 5 show a second preferred embodiment of the flashlight device, referenced as 100', having a plurality of light sources 120. The flashlight device 100' includes a centrally positioned primary light source 120 and a plurality of peripherally spaced secondary light sources 120'. The flashlight device 100' shown in FIG. 4 includes twelve secondary light sources 120', although it is to be understood that the number of secondary light sources 120' in this embodiment can alternatively be one or a plurality.

In the preferred embodiment of the flashlight device 100, 100', the primary light source 120 is a high intensity LED with a white light output. The secondary light source 120' of the flashlight device 100' preferably includes a plurality of colors or output wavelengths. For example, secondary light source 120' is shown in FIG. 4 having a plurality of red lights 120*a*', a plurality of blue lights 120*b*', and a plurality of green lights 120*c*'. Preferably, each color of secondary lights 120' is uniformly spaced around the primary light source 120. It is to be understood that the light sources 120 and 120' could include other color/wavelength options including, but not limited to, infrared, ultraviolet and microwaves.

Preferably, a control panel 140 is nested in an upper section 104*a* of the control housing 104. The control panel 140 is preferably a multi-function control panel capable of providing signals to a driver board 130 that processes the received signals and implements the required functions as described below. The control panel 140 of the preferred embodiment includes a printed circuit board ("PCB") having conductive elements activated by a multi-button keypad overlay 142. The keypad overlay 142 is preferably generally perpendicular to the longitudinal centerline 110*c* of the tubular member 110 and generally parallel to the longitudinal centerline 106*c* of the lamp and control housings 106 and 104.

In the preferred embodiment shown in FIG. 1, the multi-button keypad overlay 142 includes a momentary "on" button 144, a constant "on" button 146 and a cycle button 148 to control multiple functions of the flashlight device 100. Preferably, the buttons 144, 146 and 148 each include a raised surface to allow identification of the buttons by tactile sensation or touch without the need to identify visually. Additionally, the location and height of the buttons on the keypad overlay 142 provides for one hand, single digit operation, preferably thumb operation, as will be explained below.

Preferably, the momentary "on" button 144 is located adjacent or in proximity to the upper edge of a rear end 104*b* of the control housing 104 as shown in FIGS. 1 and 3. The momentary "on" button 144 is preferably an elongated button extending a majority of the width of the control housing 104 for reasons which will be explained below. Preferably, the momentary "on" button 144 is pressure-sensitive to functionally energize a light source, for example light source 120 in flashlight device 100, via the control panel 140 signaling the driver board 130 upon the exertion of pressure, but without locking or fixing the light source 120 in the "on" position upon the release of pressure on button 144. In this fashion, the user of the flashlight device 100 can more readily briefly energize, and then de-energize the light source 120 to fix the position of an article or person, but without continued illumination.

The constant "on" button 146 is preferably located in front (i.e., towards the lamp housing 106) of the momentary "on" button 144, and more preferably at a front left portion of the keypad overlay 142. The constant "on" button 146 has a normal state and a "depressed" state. The normal state exists when there is no pressure on the button and upon the release of pressure on the button. A first depression of button 146 to the "depressed" state causes the control panel 140 to signal the driver board 130 to energize constantly the light source, for example the light source 120 in flashlight device 100, to a constant or fixed "on" condition. Upon release of pressure on button 146, the light source remains "on". The next depression of button 146 to the "depressed" state results in the light source 120 turning "off" and remaining "off" when the button 146 returns to its normal state.

The cycle button 148 is preferably located in front of the momentary "on" button 144, and more preferably at a front right portion of the keypad overlay 142. Preferably, the cycle button 148 has a normal state and a "depressed" state. In the flashlight device 100 having a single light source 120, the cycle button 148 is used to adjust lamp brightness. For example, it may be desirable to have three brightness levels of the light source 120: low, medium and high. In this example, the brightness level of the light source 120 can be changed with each occurrence of the cycle button 148 to the "depressed" state by depressing and releasing the cycle button 148. The process may be repeated until the desired brightness level is obtained. It is to be understood that the cycle button 148 could alternatively cycle through various brightnesses by the continued depression of the cycle button 148 until such time that it is released.

In the preferred second embodiment of the flashlight device 100' having a plurality of light sources as shown in FIGS. 4 and 5, the control buttons 144, 146 and 148 may be used to provide additional and/or different functionality. The desired functionality is built into the driver board 130 and can vary depending on user specific needs. One example illustrating a desired functionality of the flashlight device 100' shown in FIGS. 4 and 5 having primary white light source 120 and secondary red, blue and green light sources 120*a*', 120*b*' and 120*c*', respectively, will now be described with reference to the momentary "on", constant "on", and cycle buttons 144, 146 and 148, respectively. The buttons 144, 146, and 148 each have two states: a normal state and a "depressed" state.

Holding the momentary "on" button 144 in its "depressed" state results in the illumination of primary light source 120 and returning the momentary "on" button 144 to its normal state by releasing pressure on the button 144 results in the primary light source 120 turning off. Depressing the momentary "on" button 144 followed by concurrent depression of the constant "on" button 146 results in the primary light source 120 being in a constant "on" condition, including upon release of the buttons 144 and 146. To turn off the primary light source 120, the constant "on" button is pressed to its "depressed" state.

With the primary light source 120 in the constant "on" condition as above described, the cycle button 148 is used to cycle through the various brightness levels (for example, low, medium and high). Each time the cycle button 148 is pressed to its "depressed" state, the brightness level will change to the next level.

With the primary light source 120 off, pressing and holding the cycle button 148 in its "depressed" state results in a signal being sent to the driver board 130 to enable and illuminate one plurality of secondary light sources, for example the red LEDs 120*a*'. Upon release of the cycle button 148 to its normal state, the red LEDs 120*a*' turn off but remain enabled. Depressing the cycle button 148 again, disables the red LEDs 120*a*' and enables and illuminates the blue LEDs 120*b*' until the cycle button 148 returns to its normal state at which time the blue LEDs 120*b*' turn off but remain enabled. Depressing the cycle button 148 disables the blue LEDs 120*b*' and enables and illuminates the green LEDs 120*c*'. Releasing and then depressing the cycle button 148 again completes the cycle back to the red LEDs 120*a*'. Thus, the cycle button 148 is used (depressed/released) to cycle through the various colors of secondary light sources 120' when the primary light source 120 is off.

Pressing the constant "on" button 146 (without concurrently depressing the momentary "on" button 144) results in the control panel 140 signaling the driver board 130 to illuminate the enabled plurality of secondary light sources, for example the red LEDs 120*a*', in their constant "on" condition. After returning to its normal state, pressing the constant "on" button again to its "depressed" state will turn off the illuminated red LEDs 120*a'*.

With a plurality of secondary light sources 120' illuminated and in their constant "on" condition, the cycle button 148 is again used to select the desired brightness of the secondary light sources 120'.

Thus, a multiplicity of functions and operations are possible via the combination of the control buttons 144, 146 and 148, the control panel 140 and the driver board 130. It is to be understood that various logic can be built into the driver board 130 to suit the various needs of users. For example, logic could be provided to produce a strobing light from a particular button sequence.

Preferably, the keypad overlay 142 is positioned above the tubular member 110 as shown in FIG. 3 to provide convenient access to the control buttons 144, 146 and 148 during use of the flashlight device. The positioning of the control buttons 144, 146 and 148 on the flashlight device 100 provides convenient access in various gun firing positions, including a two-handed combat position, or other manual hand activities. In the preferred embodiment, the buttons 144, 146 and 148 are shaped, positioned and spaced sufficiently to be tactilely recognized and easily separately depressed in addition to being adjacent one another to permit simultaneous or concurrent manipulation or depression of two buttons with a single digit of one hand of the user, preferably a thumb. Preferably, the control buttons of the keypad overlay 142 are manipulated by a single thumb and are positioned such that the user's thumb can manipulate any one of the buttons 144, 146 and 148 separately, or simultaneously or concurrently manipulate combinations of the buttons to perform various functions or operational modes. Preferably, the keypad buttons can be manipulated by the thumb without adjusting the user's grasp of the flashlight device 100, as described below, and also without having to adjust the user's grip of the firearm when in use with a firearm.

Figure 12:
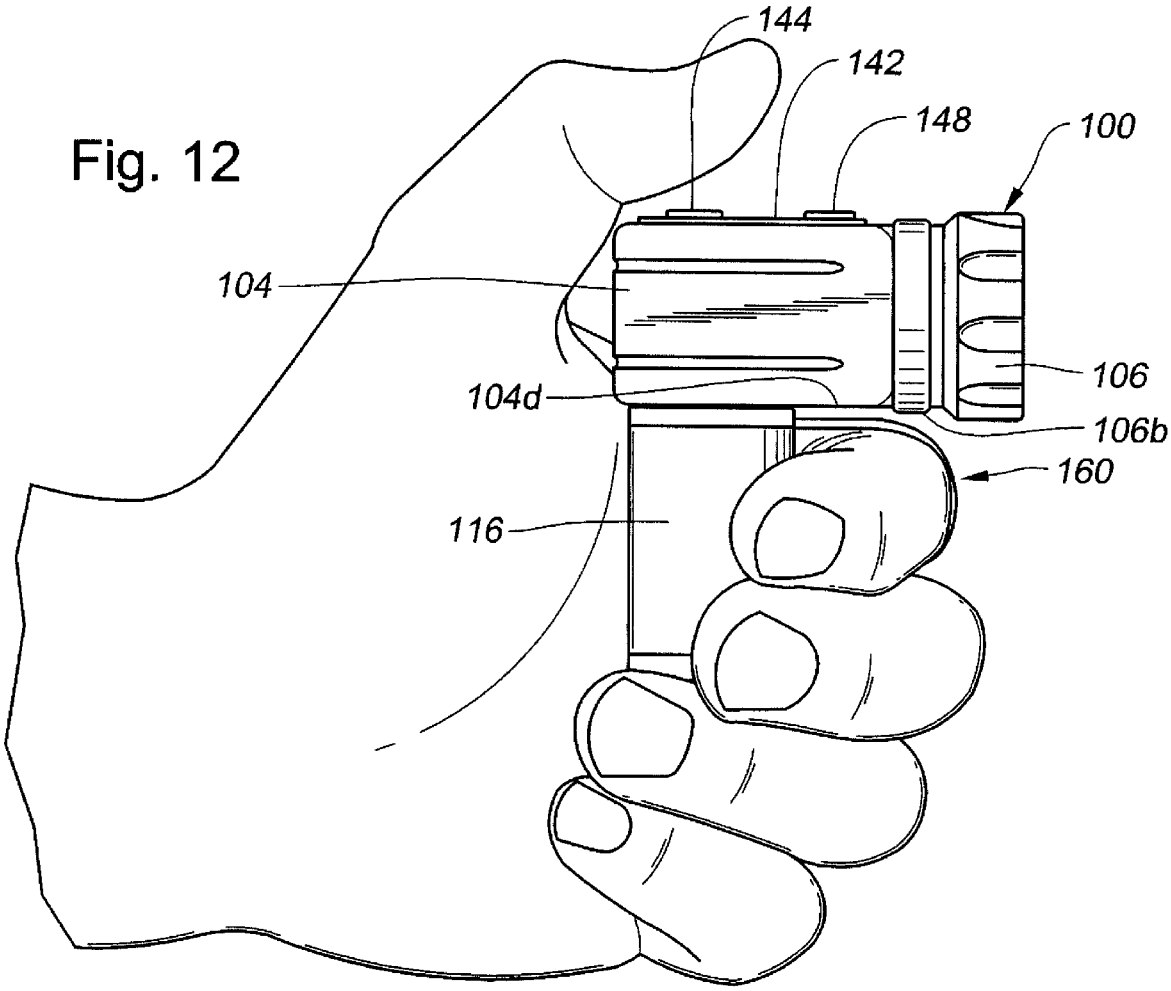
FIG. 12 is a side elevation view of the preferred embodiment of the flashlight device held in a user's hand.

As shown in FIG. 12, the flashlight device 100 is preferably grasped by wrapping one or more fingers of one hand of the user substantially around the tubular member sleeve 116 and placing the thumb of the hand on or above the keypad overlay 142. Preferably, the index finger is adjacent a forward portion of a lower surface 104*d* of the control housing 104 and/or a lower surface 106*b* of the lamp housing 106 such that when the thumb depresses the control button(s) the index finger abuts the lower surface 104*d*, 106*b* to maintain constant control and orientation of the flashlight device 100 during keypad button manipulation and use.

Preferably, the flashlight device 100 includes a "lockout" to ensure that the momentary "on" button 144 or the constant "on" button 146 is not inadvertently depressed in its "on" state while the flashlight device 100 is stored, thus draining the batteries 114 and leaving the flashlight device 100 "dead" when needed. In one embodiment of the present invention, the lockout is activated by simultaneously depressing the constant "on" button 146 and the cycle button 148 and released in the same manner. In the lockout condition, the light source 120 cannot be powered by either of the buttons 146 and 148 being pressed to their "on" state. This ensures that the flashlight device 100 is not inadvertently on while stored and is ready for use when needed by the user. In the preferred embodiment, the control panel 140 includes at least one indicator lamp 150 (FIG. 1) to provide visible indication of the "lockout" status as to whether the flashlight device 100 is "locked" or "unlocked," preferably by illuminating a symbol or icon in the upper surface of the keypad overlay 142.

The preferred embodiment of the flashlight device 100 includes a sleeve 116, preferably a cushioned sleeve, adapted to be slid onto the tubular member 110 and secured in position via, for example, the tail cap 112. The sleeve 116 is preferably an elastomeric cushion which serves to increase the tactile feel of the finger gripping area of the tubular member 110.

Figure 6:
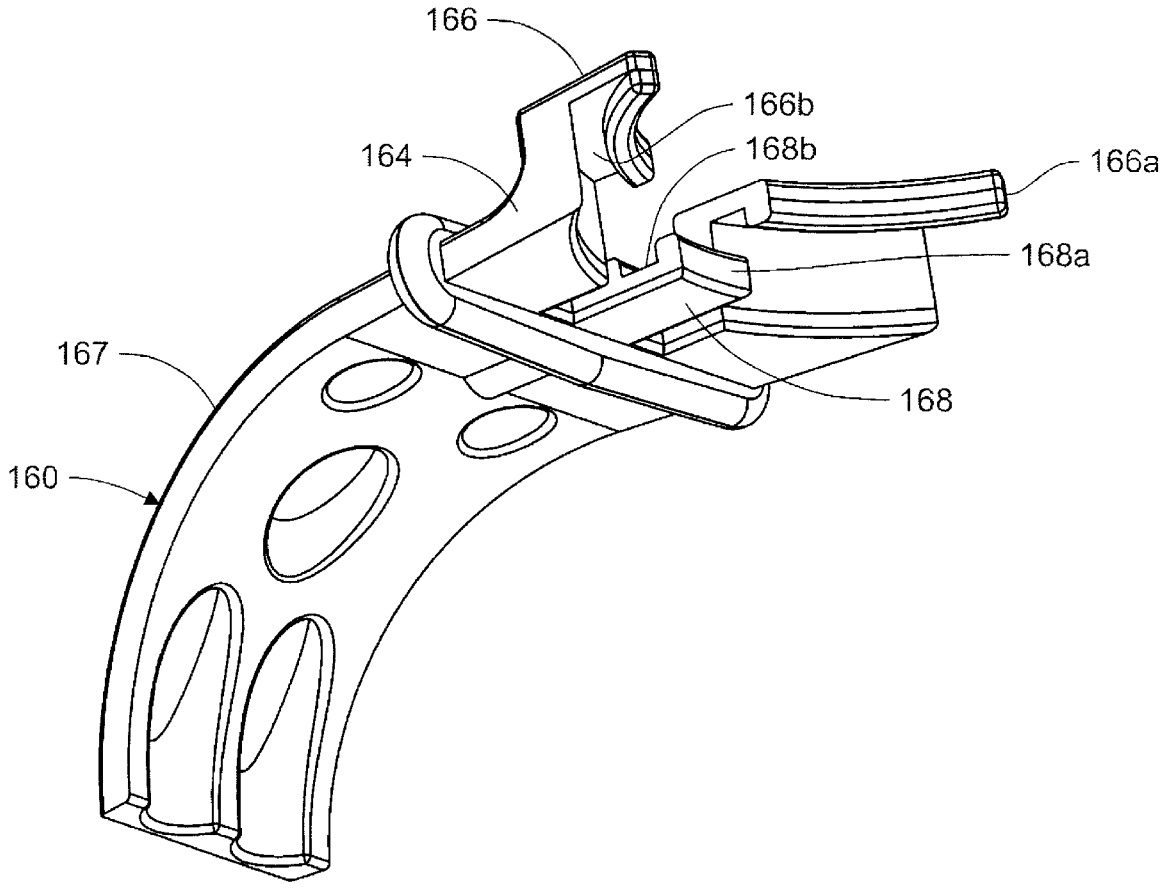
FIG. 6 is a perspective view of a preferred embodiment of a finger retainer for use with the flashlight device of FIG. 1.
Figure 7:
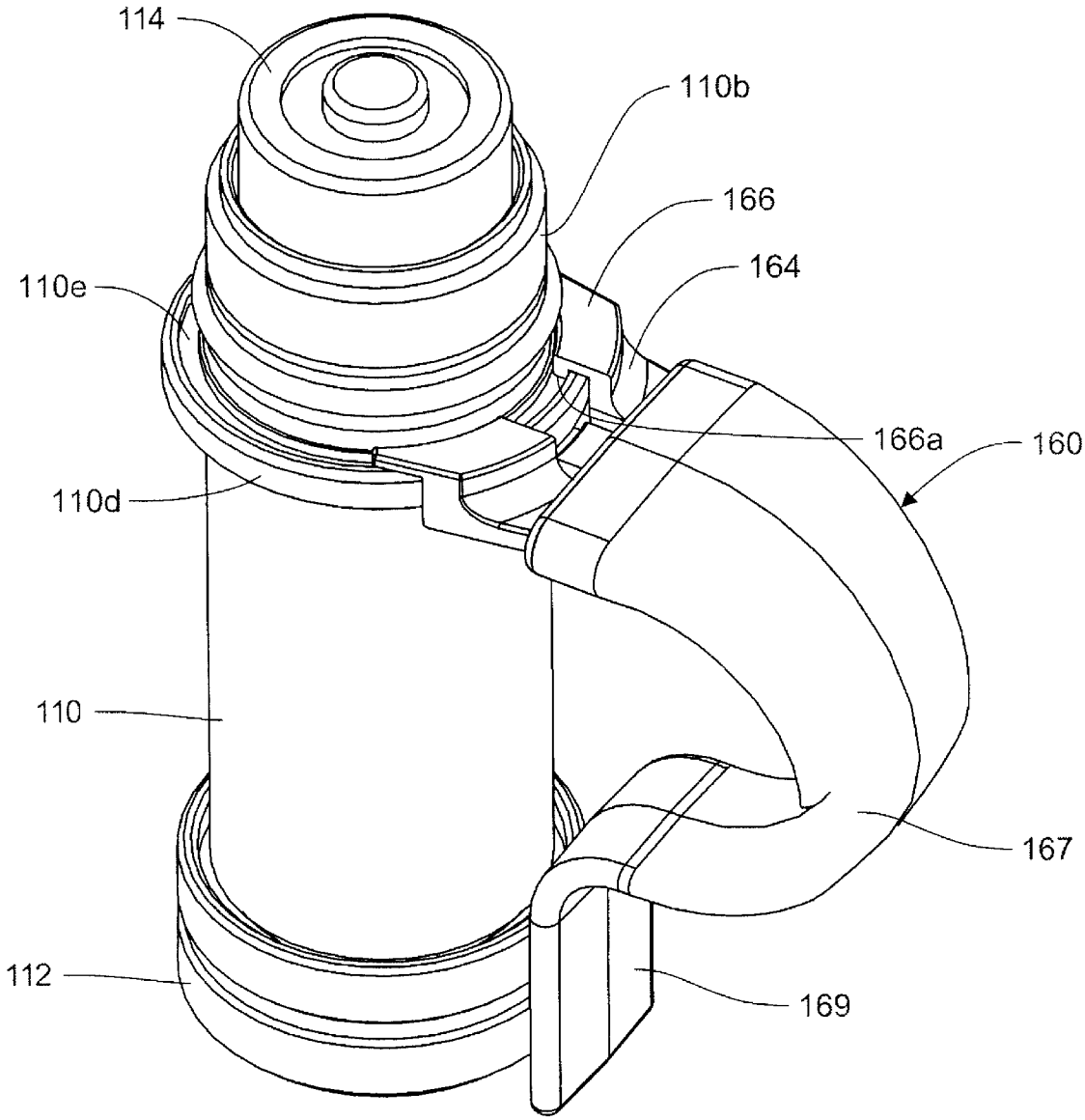
FIGS. 7 and 8 are perspective views showing the finger retainer coupled to the flashlight device.
Figure 8:
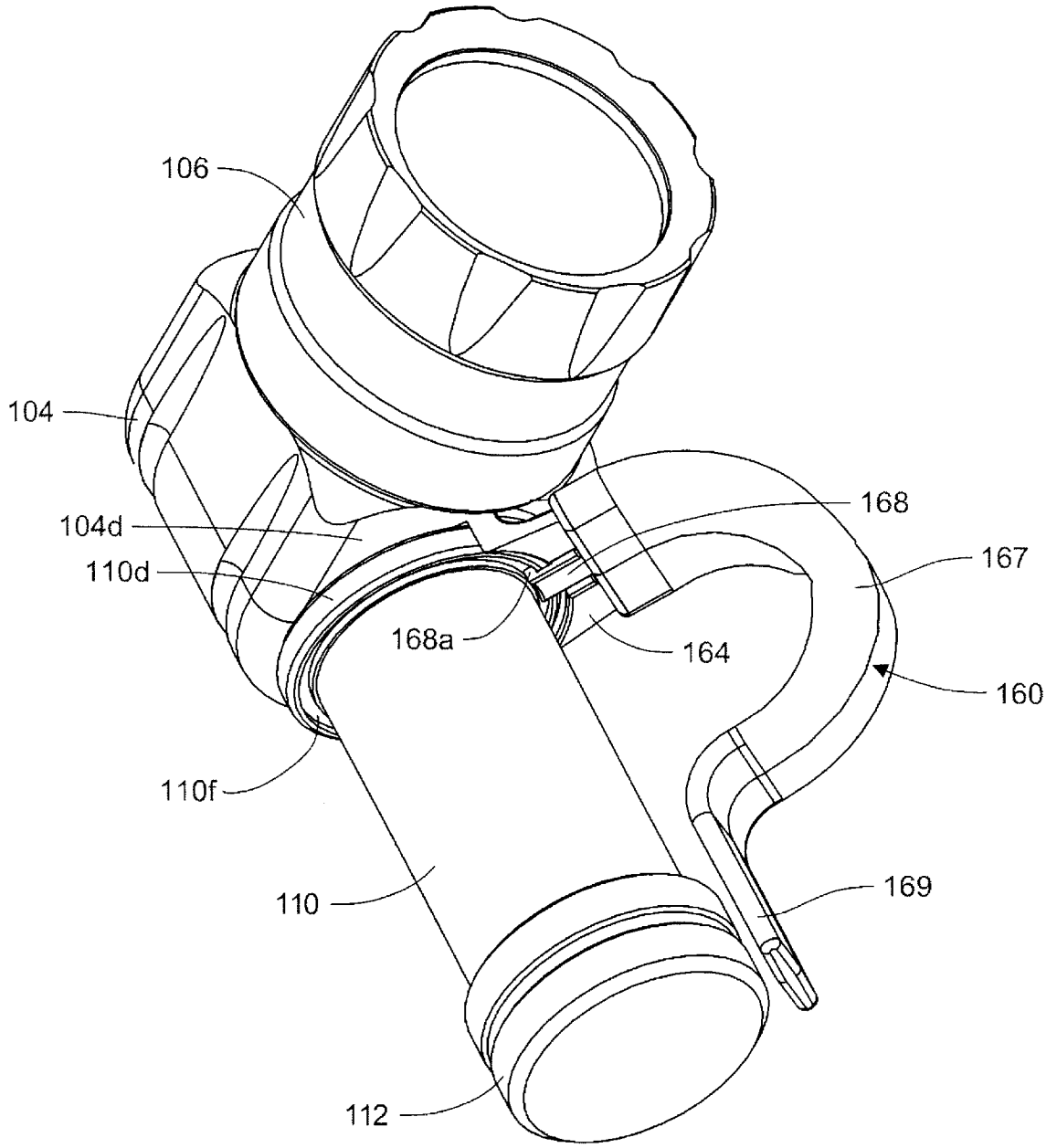

A preferred embodiment of the flashlight device 100 also includes a finger retainer assembly 160. A perspective view of a portion of the preferred embodiment of the finger retainer assembly 160 is shown in FIG. 6 and FIGS. 7 and 8 are perspective views showing the finger retainer assembly 160 coupled to the flashlight device 100. With reference to FIGS. 2 and 4, the finger retainer assembly 160 preferably defines a substantially "D"-shaped opening 162 with the battery tubular member 110. In the preferred embodiment, the finger retainer assembly 160 includes a first end portion 164, a curved portion 167, and a tail portion 169. The finger retainer assembly 160 may be of unitary construction, or alternatively, may be a multi-part assembly. Preferably, the finger retainer assembly 160 is made of an elastomer material arranged and designed to fit snugly against the user's finger, preferably the index or middle finger, when inserted through the opening 162. Preferably, the curved portion 167 of the finger retainer assembly 160 is semi-rigid to generally retain its curvature but with flexibility to provide expansion of the size of the opening 162 to comfortably accommodate fingers of various sizes.

In the preferred embodiment, the first end portion 164 is arranged and designed to connect to a connecting portion 110*d* of the tubular member 110. As shown in FIG. 3, the connecting portion 110*d* preferably comprises a generally "T"-shaped peripheral ring defining a circumferential upper recess 110*e* and a circumferential lower recess 110*f*. Referring to FIG. 6, the first end portion 164 includes an upper portion 166 having a lip 166*a* and a downwardly-facing arcuate groove 166*b*. The first end portion 164 also includes a lower portion 168 having a lip 168*a* and an upwardly-facing arcuate groove 168*b*. Preferably, the upper portion lip 166*a* and the lower portion lip 168*a* are arcuate and arranged and designed to be received in the circumferential upper and lower recesses 110*e* and 110*f*, respectively, as shown in FIG. 3. With reference to FIG. 7, when coupled to the connecting portion 110*d* of the tubular member 110, the finger retainer assembly 160 is permitted to move to any position around the circumference of the tubular member 110.

The finger retainer assembly 160 can be adjusted and fixed in the user's desired position by tightening, preferably via a threaded connection, the upper end 110*b* of the tubular member 110 to the control housing 104. As shown in FIGS. 3 and 8, the upper portion 166 of the first end portion 164 of the finger retainer assembly 160 is squeezed between the tubular member connecting portion 110*d* and a lower surface 104*d* of the control housing 104, thus maintaining the angular position of the finger retainer assembly 160 relative to the optical axis of the light source 120, preferably the centerline 106*c* of the lamp housing 106. The preferred embodiment allows the angular position of the finger retainer assembly 160 relative to the optical axis 106*c* of the light source 120 to be infinitely adjusted in a horizontal plane (when the tubular member 110 is in a vertical orientation) by untightening the connection between the tubular member 110 and the control housing 104, making the desired adjustment, and re-tightening the connection.

Referring to FIGS. 3 and 7, the batteries 114 can be replaced by disconnecting the tubular member 110 from the control housing 104. However, in the preferred embodiment, the batteries 114 can also be replaced by removing the tail cap 112 from the tubular member 110. Replacement of batteries 114 via the tail cap 112 has the advantage of not altering or affecting the angular positioning of the finger retainer assembly 160 relative to the optical axis 106*c*.

As shown in FIGS. 3 and 5, the sleeve 116 on the tubular member 110 preferably abuts the lower portion 168 of the first end portion 164 to prevent the dislocation of the finger retainer assembly 160 from the tubular member 110, particularly when the tubular member 110 is loosened from the control housing 104.

The flashlight device 100 is ergonomically designed in addition to being small and compact. The overall length of the flashlight device 100 has been minimized by positioning the top battery 114 behind the light source 120 as shown in FIG. 3. This allows the batteries 114 to be in close proximity to the control panel 140. The preferred embodiment of the flashlight device 100 has an overall length of approximately 3.5 inches (3.5") from the keypad overlay 142 to the tail cap 112. The length of the joined control and lamp housings 104 and 106 is approximately 2.5" and the diameter at the forward end 106*a* is approximately 1.5" in the preferred embodiment.

Figure 9:
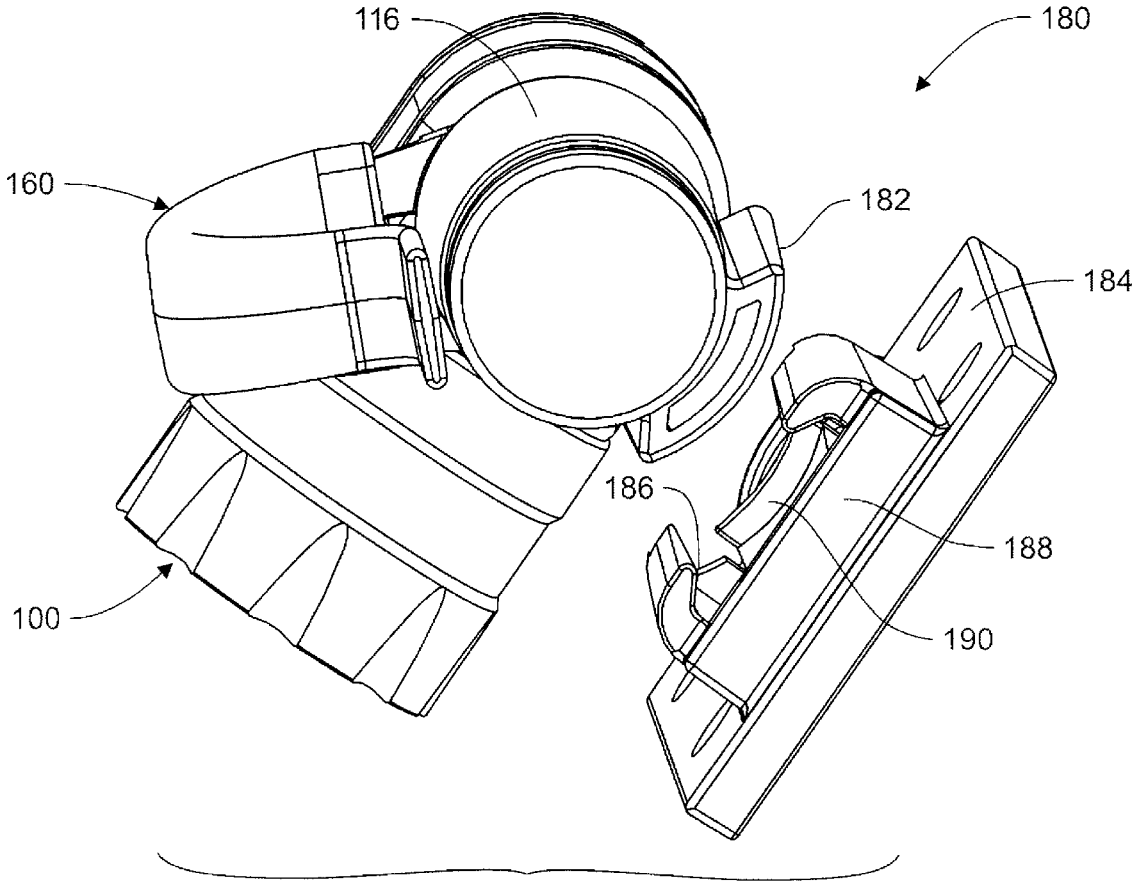
FIG. 9 is an exploded perspective view of a tactical retention system in use with the flashlight device according to an embodiment of the present invention.

A preferred embodiment of the tactical retention system 180 is shown in FIGS. 9 and 10. The tactical retention system 180 preferably includes first and second mating components 182 and 184, respectively, to permit "hands-free" applications. Referring to FIG. 9, the first mating component 182 is preferably an elongated dovetail extension extending from the sleeve 116 adapted to be slidably received within a corresponding receptacle 186 of the second mating component 184. The receptacle 186 includes a bottom member 188 to limit the longitudinal downward movement of the flashlight device 100 in the second mating component 184 of the retention system 180.

As shown in FIG. 10, the second mating component 184 is preferably arranged and designed to be mounted or attached to various articles of clothing, including, but not limited to, uniforms, belts, jackets and headgear. Preferably, the second mating component 184 includes a catch member 190 that prevents longitudinal upward movement of the first mating component 182 within the receptacle 186. The catch member 190 is preferably a spring member permitting entry of the first mating component 182 into the receptacle 186 and requiring manual manipulation of the catch member 190 prior to removing the first mating component 182 from the receptacle 186. Referring to FIG. 10, a slide member 192 is arranged and designed to manipulate the catch member 190 in such a way as to allow the removal of the first mating component 182 from the receptacle 186.

It is to be understood that the angular position of the first mating component 182 relative to the optical axis 106*c* is adjustable through at least 180°, thus allowing at least 180° of orientation of the optical axis 106*c* relative to the second mating component 184 when seated in the receptacle 186 (FIG. 10).

Figure 11:
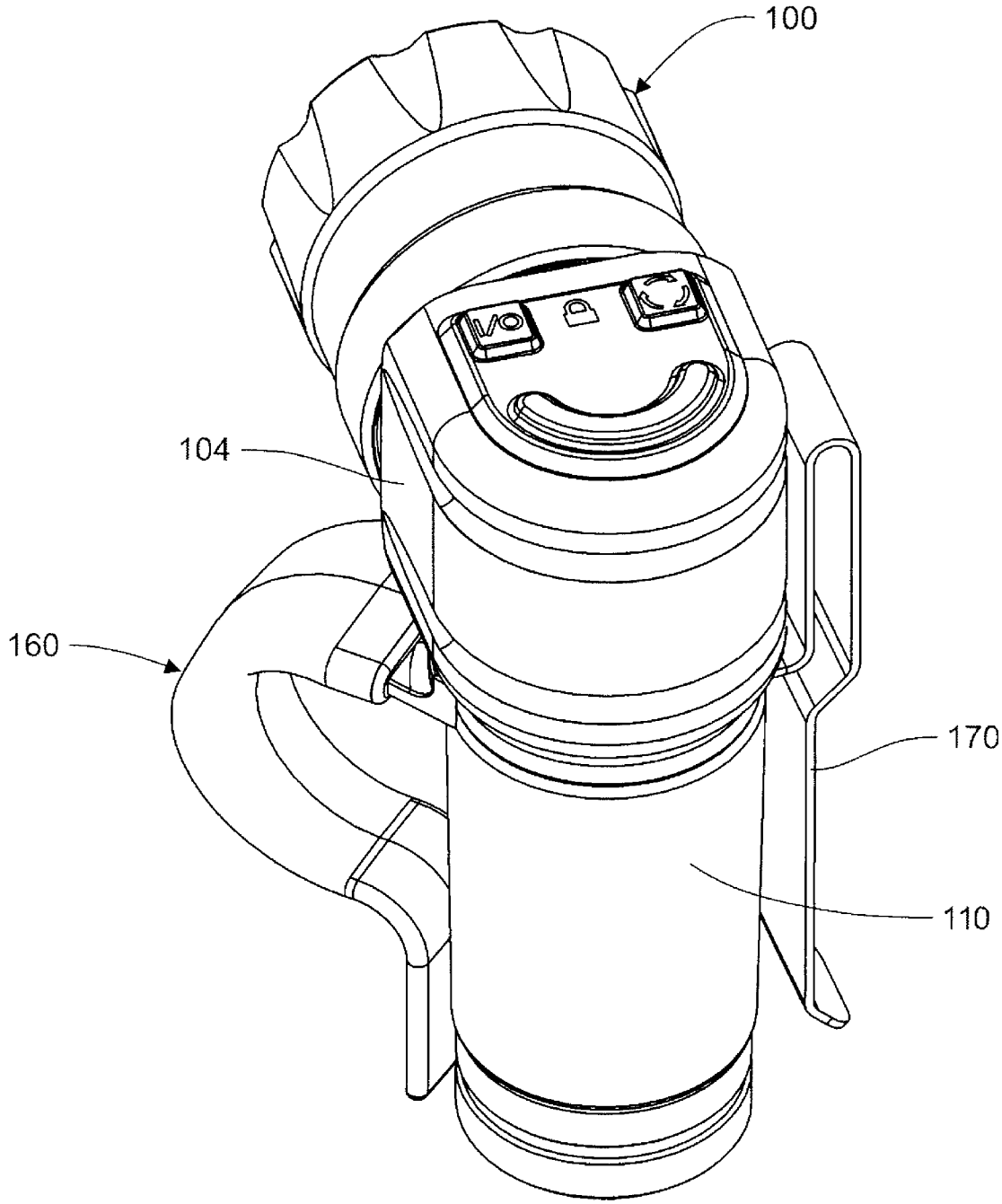
FIG. 11 is a perspective view of a flashlight device having a finger retainer and belt clip.

FIG. 11 shows a flashlight device 100 having a finger retainer assembly 160 and a belt clip 170. The belt clip 170 is arranged and designed to clip onto a user's belt or other article of clothing or portion of a uniform, including for example a soldier's uniform, forming a friction fit. Such clips are well known in the art. Preferably, the belt clip 170 includes a ring (not shown) that slides onto the upper end 110*b* of the tubular member 110 and is secured upon tightening the tubular member 110 to the control housing 104.

Figure 13:
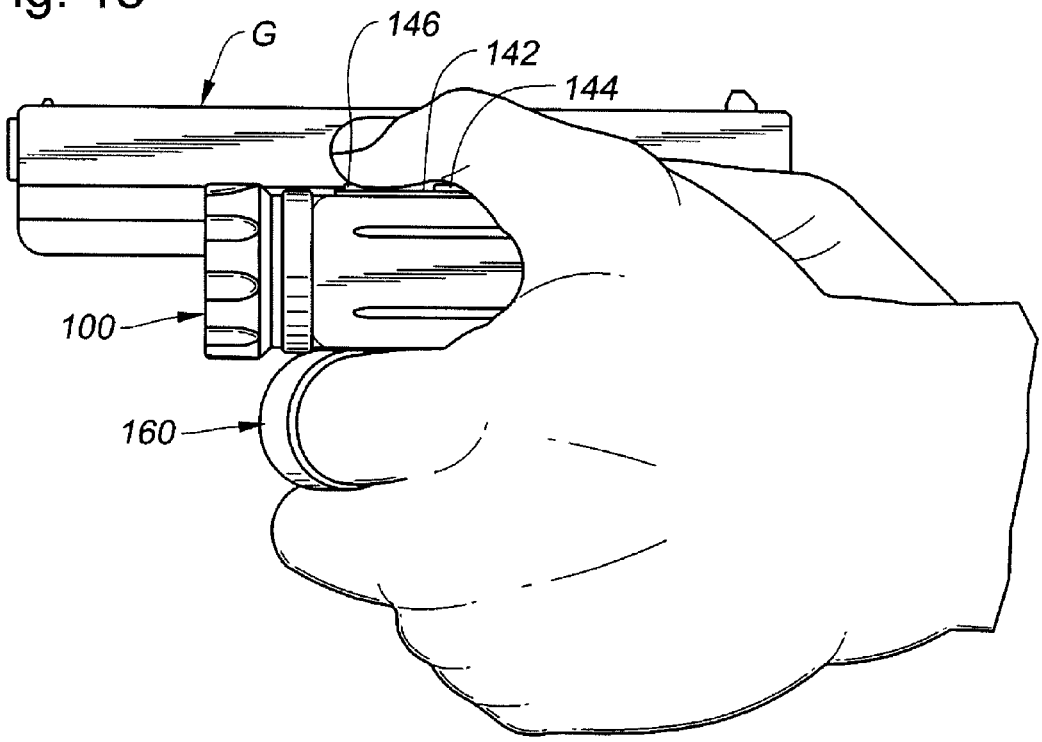
FIGS. 13 and 14 are side and front elevation views, respectively, of the preferred embodiment of the flashlight device in use during a two-handed firing position.
Figure 14:
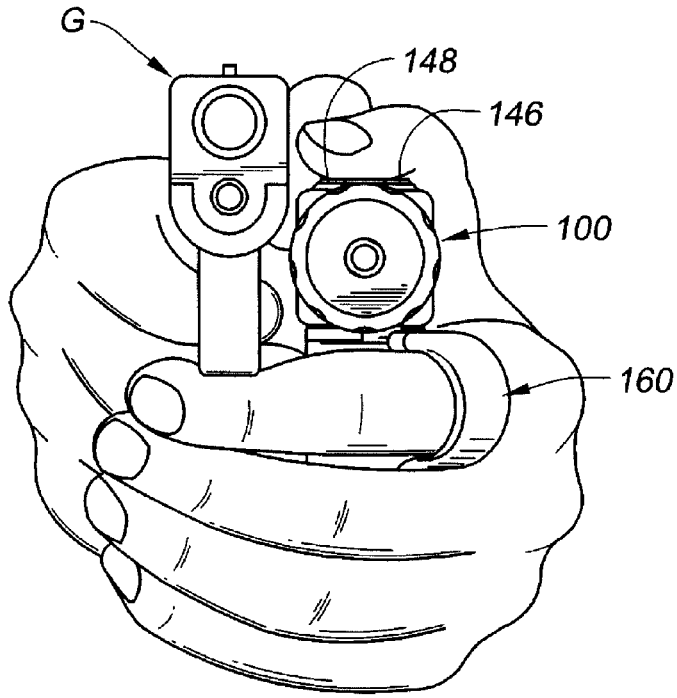

FIGS. 13 and 14 illustrate the flashlight device 100 according to an embodiment of the present invention being used with a handheld firearm G in a two-handed firing position. In FIG. 14, a right-handed shooter is shown with the shooter's right index finger on the trigger, the right thumb to the left of the gun barrel, and the remaining three fingers on the right hand (not shown) curled around the firearm grip. Preferably, the index finger of the left hand extends through the opening 162 of the finger retainer assembly 160 and the middle finger presses against the tail portion 169 (not shown) to provide additional stability and control. Preferably, the left thumb is positioned above the keypad overlay 142 and adjacent the control buttons 144, 146 and 148 and the other four fingers are curled around the firearm grip on top of the three curled right fingers. When held in this manner, the tubular member 110 (not shown) is preferably in abutting relationship with one or more of the curled right fingers. Alternatively, the flashlight device 100 may be held with one or more fingers on the left hand curled around the tubular member 110 and abut the firearm grip or the three curled fingers of the right hand.

FIGS. 15 and 16 show some basic gun handling maneuvers and how the flashlight device according to the present invention does not inhibit such maneuvers. With the flashlight device 100 attached to the user's non-shooting hand, FIG. 15 illustrates the removal or insertion of a firearm's magazine M and FIG. 16 illustrates the operation of a firearm's slide S. It is vitally important to the user to be able to do such maneuvers quickly and easily and without interference by the flashlight device 100. Although the present invention has been described above for use with a handgun, it can also be used with long guns, including rifles and shotguns.

It is to be understood that while the flashlight device of the present invention has been described primary with reference to flashlight device 100 having a single light source 120, the description generally also pertains to flashlight device 100' having a plurality of light sources 120, 120'. It is to be understood that the finger retainer assembly 160, the belt clip 170, and the tactical retention system 180 are applicable to all embodiments. It is further to be understood that the flashlight device of the present invention may be used with or without each of the following: sleeve 116, finger retainer assembly 160, belt clip 170, and retention system 180.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

We claim:

1. A flashlight apparatus, comprising:

an assemblage including an upper assembly and a finger-gripping assembly, said upper assembly having a control surface positioned at a top thereof, and said finger-gripping assembly coupled to said upper assembly wherein said finger-gripping assembly includes a sleeve rotatably disposed around a tubular member;

wherein said control surface is arranged and designed for manipulation by a thumb of a user's hand; and wherein at least a portion of said finger-gripping assembly is rotatable relative to said upper assembly.

2. The flashlight apparatus of claim 1, further comprising a mounting component arranged and designed for attachment to an external article or surface, and wherein said sleeve has an integral mating component configured to releasably mate with said mounting component.

3. The flashlight apparatus of claim 2, further comprising a finger retainer assembly coupled to said assemblage.

4. The flashlight apparatus of claim 3, further comprising a clip coupled to said assemblage.

5. The flashlight apparatus of claim 1, wherein said control surface includes a control button.

6. The flashlight apparatus of claim 1, wherein said control surface includes a plurality of control buttons.

7. The flashlight apparatus of claim 6, wherein said plurality of control buttons are configured so that more than one button may be contacted simultaneously by the user's thumb.

8. The flashlight apparatus of claim 1, wherein said finger-gripping assembly has a grip section adjacent a bottom of said upper assembly such that when a user grips said grip section, a finger of the user's hand supports the bottom of said upper assembly while the thumb contacts said control surface, thereby restraining said assemblage between the thumb and the finger of the user.

* * * * *